United States Patent [19]

Schedele

[11] 4,403,203

[45] Sep. 6, 1983

[54] POLARIZED ELECTROMAGNETIC RELAY

[75] Inventor: Helmut Schedele, Diessen, Fed. Rep. of Germany

[73] Assignee: Siemens Aktiengesellschaft, Berlin & Munich, Fed. Rep. of Germany

[21] Appl. No.: 323,444

[22] Filed: Nov. 20, 1981

[30] Foreign Application Priority Data

Jan. 13, 1981 [DE] Fed. Rep. of Germany ..... 3100817

[51] Int. Cl.[3] ..... H01H 51/22

[52] U.S. Cl. ..... 335/78; 335/81; 335/179

[58] Field of Search ..... 335/78, 79, 81, 179, 335/229

[56] References Cited

U.S. PATENT DOCUMENTS 4,215,329 7/1980 Kobler ..... 335/78

*Primary Examiner*—Harold Broome

*Attorney, Agent, or Firm*—Hill, Van Santen, Steadman & Simpson

[57] ABSTRACT

A polarized electromagnetic relay has a coil core body comprised of insulating material having a ferromagnetic movable contact element disposed in a hollow interior thereof, the movable contact element having a free end movable between two pole plates which are mounted in a flange of said coil body and which enclose a permanent magnet in a chamber of the coil body. The movable contact element is secured at its opposite end to a carrier which forms a ferromagnetic flux guidance plate extending substantially through the entire interior of the coil which is wound about the coil body and which terminates in close proximity to the pole plates.

10 Claims, 8 Drawing Figures

POLARIZED ELECTROMAGNETIC RELAY

BACKGROUND OF THE INVENTION

1. Field of the Invention

The present invention relates to polarized electromagnetic relays and in particular to such relays having a one-piece coil core body having a hollow interior with a movable ferromagnetic contact element disposed in the interior of the body.

2. Description of the Prior Art

A polarized electromagnetic relay is known, for example, from German AS No. 27 23 220, which corresponds to U.S. Pat. No. 4,215,329, having a one-piece coil body about which an electromagnetic coil is wound which has a hollow tube-like interior in which a movable ferromagnetic contact element is disposed substantially parallel to the longitudinal axis of the coil body. The contact element is fastened at one end to a carrier which is received in grooves of the coil body parallel to the coil axis and has an opposite free end which is movable between two angled pole plates associated with a permanent magnet, the pole plates being held in a flange of the coil body by means of a plug-type connection.

Relays constructed in the manner described above provide a very high grade relay which achieves a good closing of the permanent magnetic circuit as well as a good connection of the control flux circuit by virture of the end-face coupling of the permanent magnet to the pole pieces and further by means of additional flux guidance tabs which are carried on the pole pieces. The carrier for the movable contact element inside the coil body is an elongated adjustment plate which can be deformed for adjusting the movable contact element by means of an externally applied magnetic field after the relay has been hermetically sealed such as, for example, by casting.

Relays of this type have the disadvantage that all parts of the relay within the protective housing of the relay must be hermetically sealed therein by casting. Moreover, a special device for generating magnetic pulses and for the measurement of the various armature positions resulting from such pulses is necessary for step-by-step magnetic adjustment of the movable contact element. The development of such special devices may be uneconomical in those instances in which the demands made on the relay insofar as contact tolerances are not especially high, and also in those instances wherein a relatively small number of relays are needed.

SUMMARY OF THE INVENTION

It is an object of the present invention to provide a relay which has a one-piece coil core body and a movable contact element disposed in a hollow interior thereof which is simple and inexpensive to manufacture and assemble and which exhibits useable electrical and mechanical values such that the relay is ready to be employed even in the absence of hermetic casting.

The above object is inventively achieved in a relay of the type described above wherein the carrier for the movable contact element extends in the hollow interior of the coil core body in the form of at least one flux guidance plate and which is mounted in continuous grooves in the coil body such that the flux guidance plate terminates in close proximity to the pole plates.

The flux guidance plate is firmly anchored in the grooves of the coil body up to its end. Magnetic adjustment of the carrier, of which the flux guidance plate is a part, can thus no longer be undertaken, however, the flux guidance plate constructed in this manner permits adjustment of the movable contact element attached thereto as a unit with the carrier before insertion of the carrier-movable contact element assembly into the coil body. The movable contact element is thus adjusted in relationship to the flux guidance plate and the flux guidance plate is subsequently precisely positioned in the coil body in relation to the pole plates which are likewise mounted in guidance means within the coil body so that the movable contact element is thereby also adjusted in relation to the pole plates. The adjustment is retained upon insertion of the pole plate into the coil body.

A further advantage of the flux guidance plate constructed in accordance with the principles of the present invention is that the carrier of which the flux guidance plate is a part conducts the magnetic flux, and in particular the control flux, substantially in the entire volume within the coil winding and thus improves the magnetic circuit of the relay. The movable contact element, which has a relatively small cross section in order to achieve a low mass and a high elasticity, need only bridge a relatively small air gap between the flux guidance plate and the pole plates when it is switched.

A further improvement of the stability of the carrier for the movable contact element and of the magnetic circuit is achieved in an embodiment of the invention wherein the carrier forms two flux guidance plates which terminate in proximity to the two pole plates and which are disposed approximately parallel at both sides of the movable contact element. The guidance grooves for these flux guidance plates are disposed in the coil bodies such that the two plates directly align with the contacting ends of the pole plates. Thus preadjustment of the movable contact element in relationship to the carrier having two flux guidance plates can be tailored to conditions in the relay itself.

In another embodiment of the relay, the coil flange which receives the pole plates is closed at an end face and forms a chamber which is open at the top which has guidance grooves for the two plates and passages at a bottom of the chamber at a terminal side of the relay through which terminal pins extend from the pole plates. The chamber has an orbital rim at its upper side which can be closed with a planar cover. The design of the coil flange as a chamber which is open at the top simplifies assembly because the pole plates are entirely accepted in the chamber. Thus, no gaps between the pole plates and the coil body is present which must be subsequently sealed. The chamber is closed by means of placing a planar cover thereover which may consist, for example, of synthetic material, on the rim of the coil body flange, which also may consist of synthetic material. The relay is thus sealed dust-tight with a ferromagnetic cover which also serves the dual purpose of flux guidance and is ready for use. A hermetic seal can also be added, but is not necessary. If a hermetic seal is employed, the ferromagnetic cover is filled in a known manner with casting compound, which simultaneously seals the passages for the terminal pins in the coil core body.

The flux guidance plates for the carrier as well as the contact surfaces of the movable contact element and of the pole plates may be disposed parallel to the terminal plane of the relay or, in a further embodiment, may be rotated by 90° about the longitudinal coil body axis, so that the pole surfaces and flux guidance plates are disposed perpendicular to the terminal plane of the relay.

The permanent magnet for pre-magnetization of the pole plates is disposed in the above-mentioned chamber in the coil flange between the pole plates. An asymmetrical mounting of the permanent magnet can be undertaken with the permanent magnet resting with one pole surface seated against a pole plate and with a greater distance existing between the other pole plate and the other pole surface of the permanent magnet. This greater distance can be occupied by a non-magnetic filler consisting of, for example, synthetic material. Thus the two pole plates and the permanent magnet can be braced with respect to each other in the chamber of the coil flange and can be rigidly positioned. In addition, a retaining element can be formed on the coil flange for fixing the position of the permanent magnet along the axial direction of the coil.

The carrier for the movable contact element has a terminal pin formed thereon in a known manner at that side of the coil body which is opposite to the pole plates. In order to improve the magnetic coupling of the carrier to the ferromagnetic housing, it is preferable to provide the carrier with a large-surface flux transfer plate which is disposed parallel to the end wall of the housing against the end face of the coil body. The end of the carrier, or of the flux transfer plate, can be covered with a fleece or plastic foil when the relay is cast in order to prevent the penetration of casting compound into the interior of the coil body.

DESCRIPTION OF THE PREFERRED EMBODIMENTS

Figure 1:
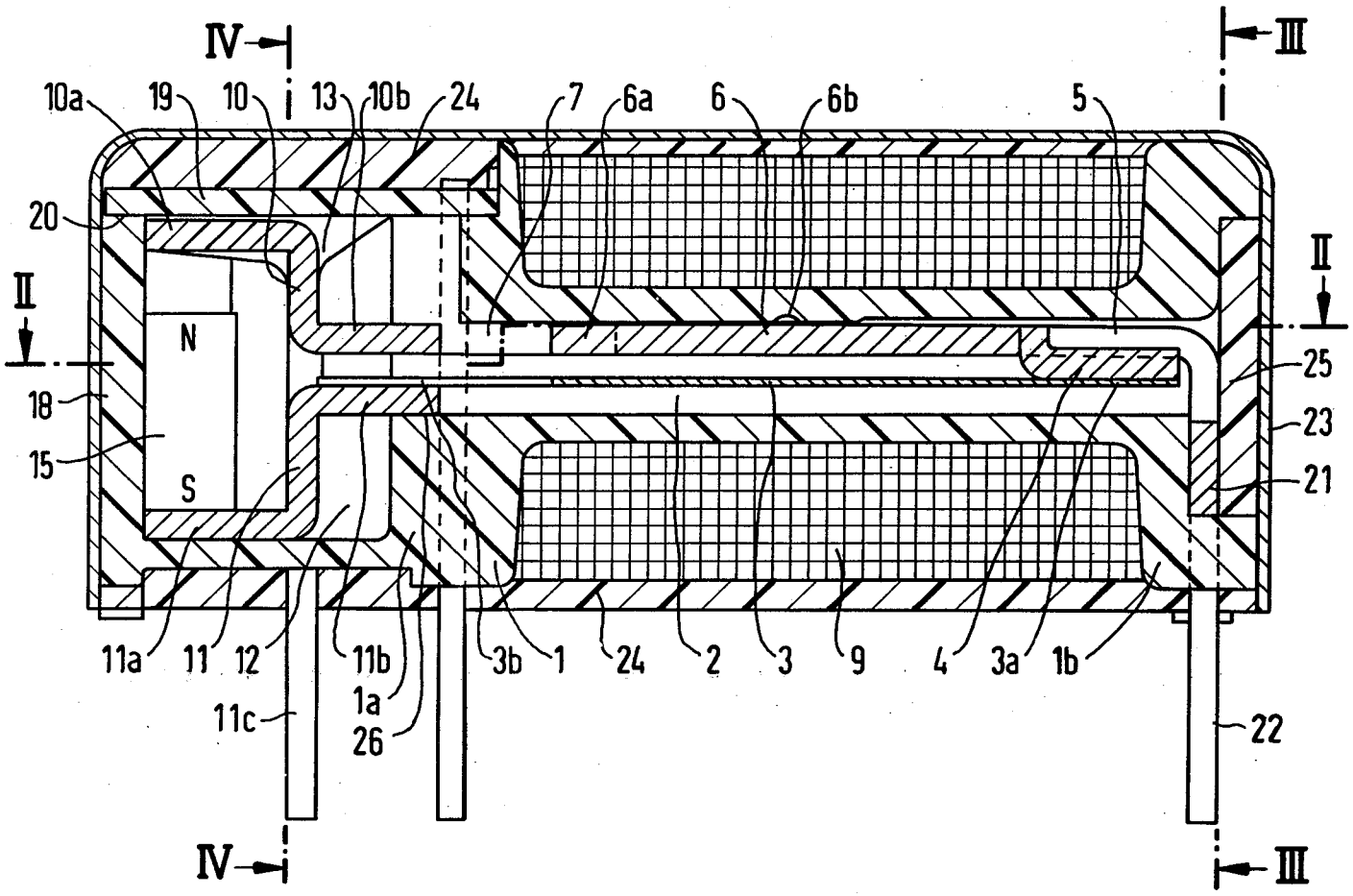
FIG. 1 is a sectional view of a polarized electromagnetic relay having an elongated flux guidance plate constructed in accordance with the principles of the present invention.
Figure 2:
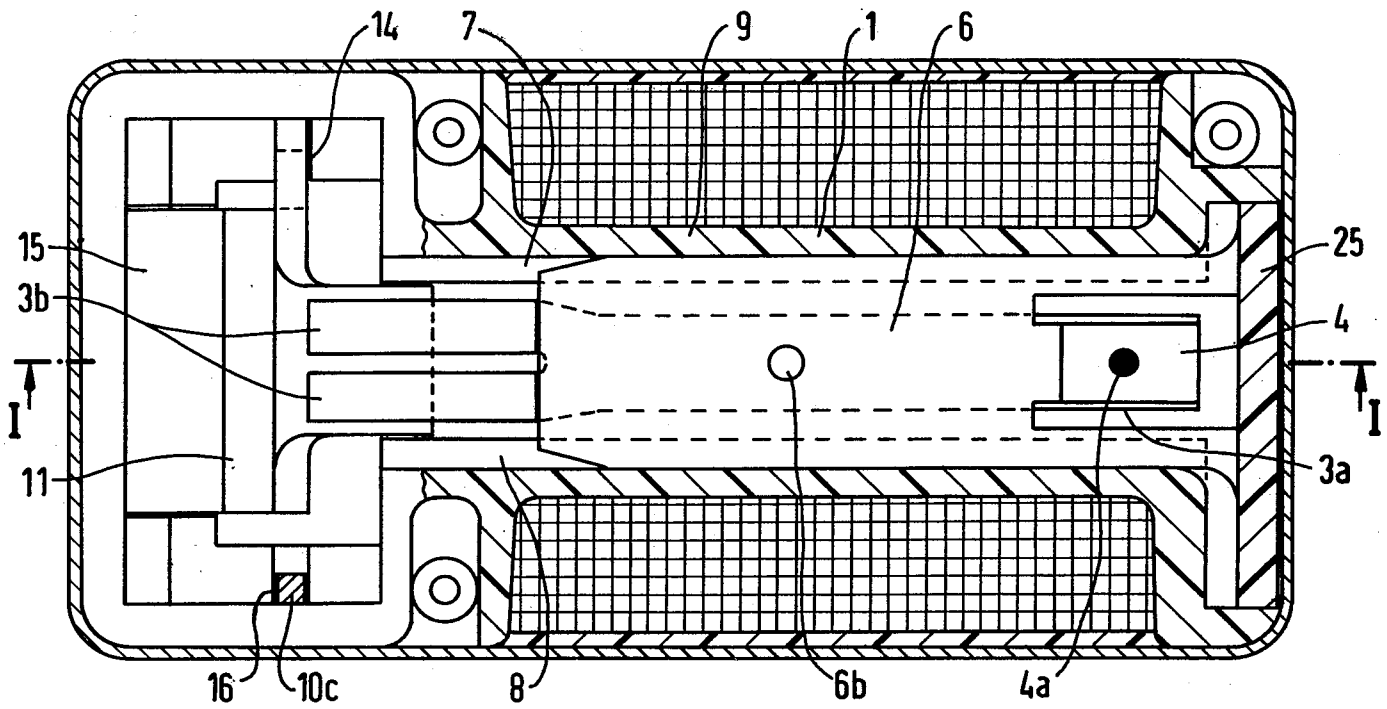
FIG. 2 is a sectional view taken along line II—II of FIG. 1.
Figure 4:
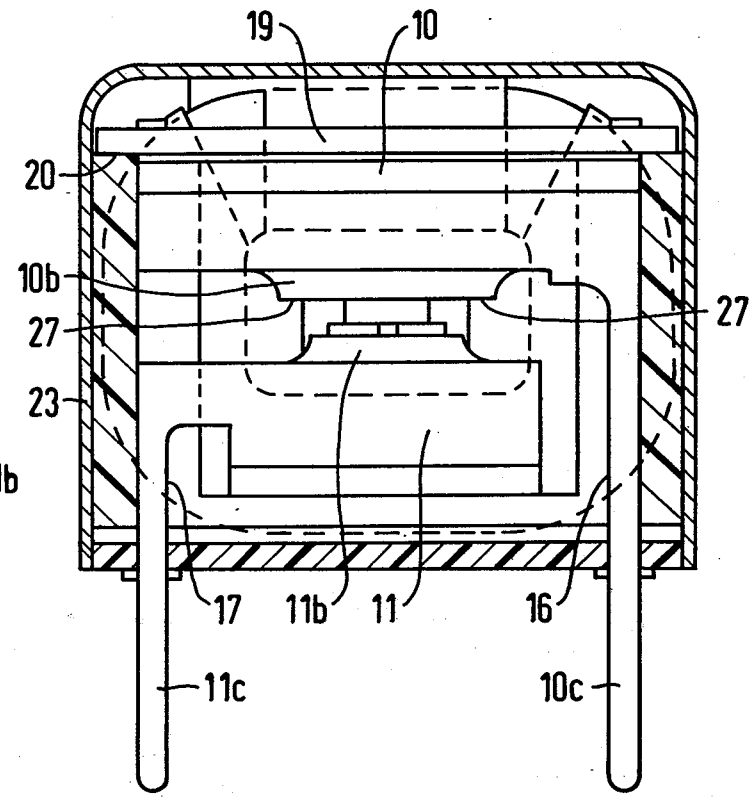
FIG. 4 is a sectional view taken along line IV—IV of FIG. 1.
Figure 3:
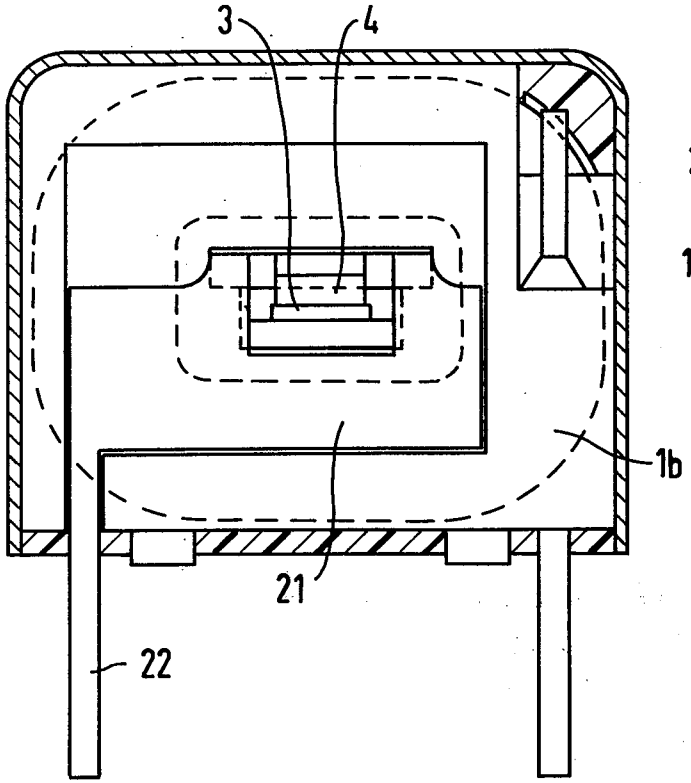
FIG. 3 is a sectional view taken along line III—III of FIG. 1.
Figure 5:
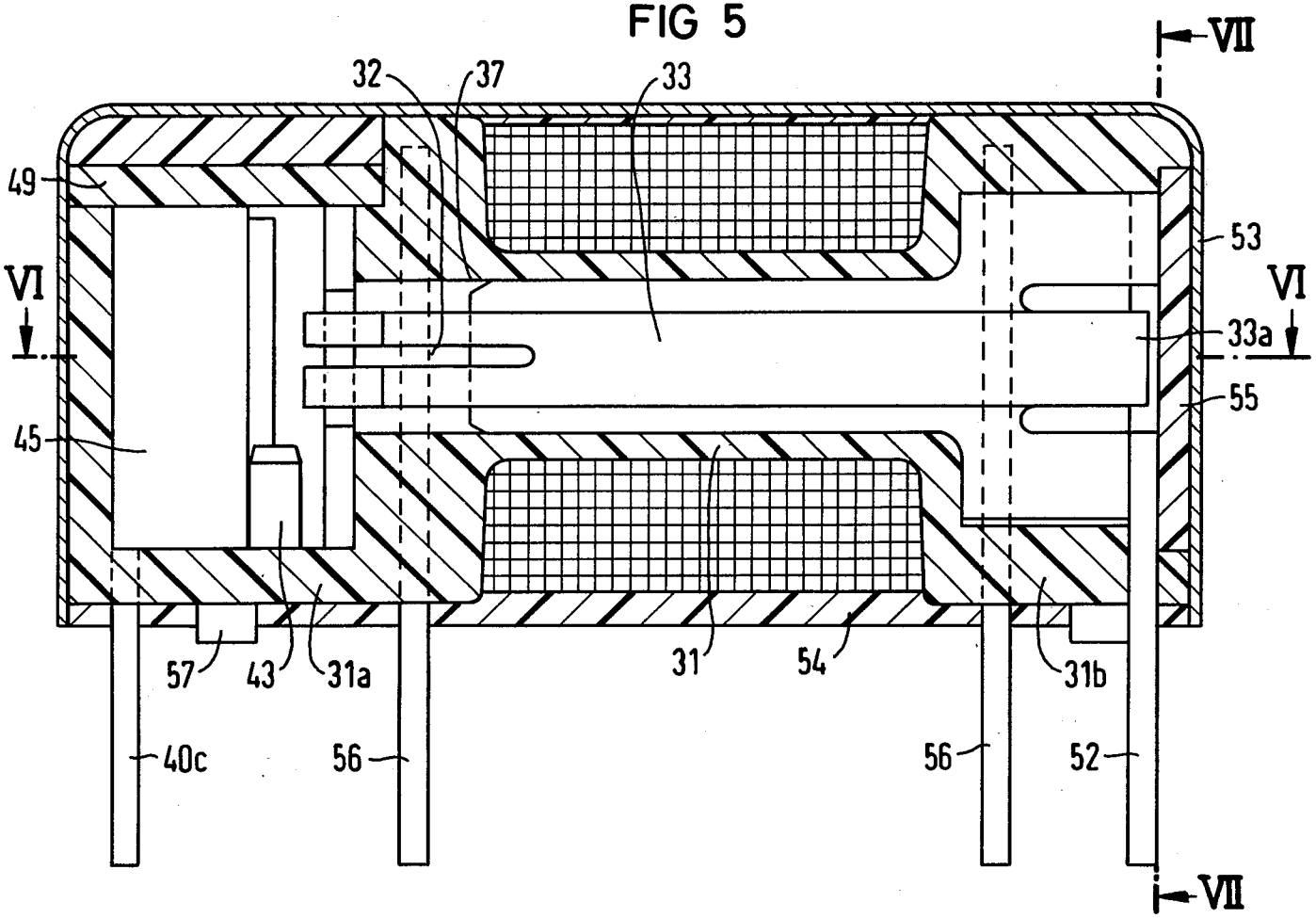
FIG. 5 is a sectional view of a further embodiment of the relay shown in FIG. 1 with the movable contact element and flux guidance plate rotated 90° about a longitudinal axis of the coil.
Figure 6:
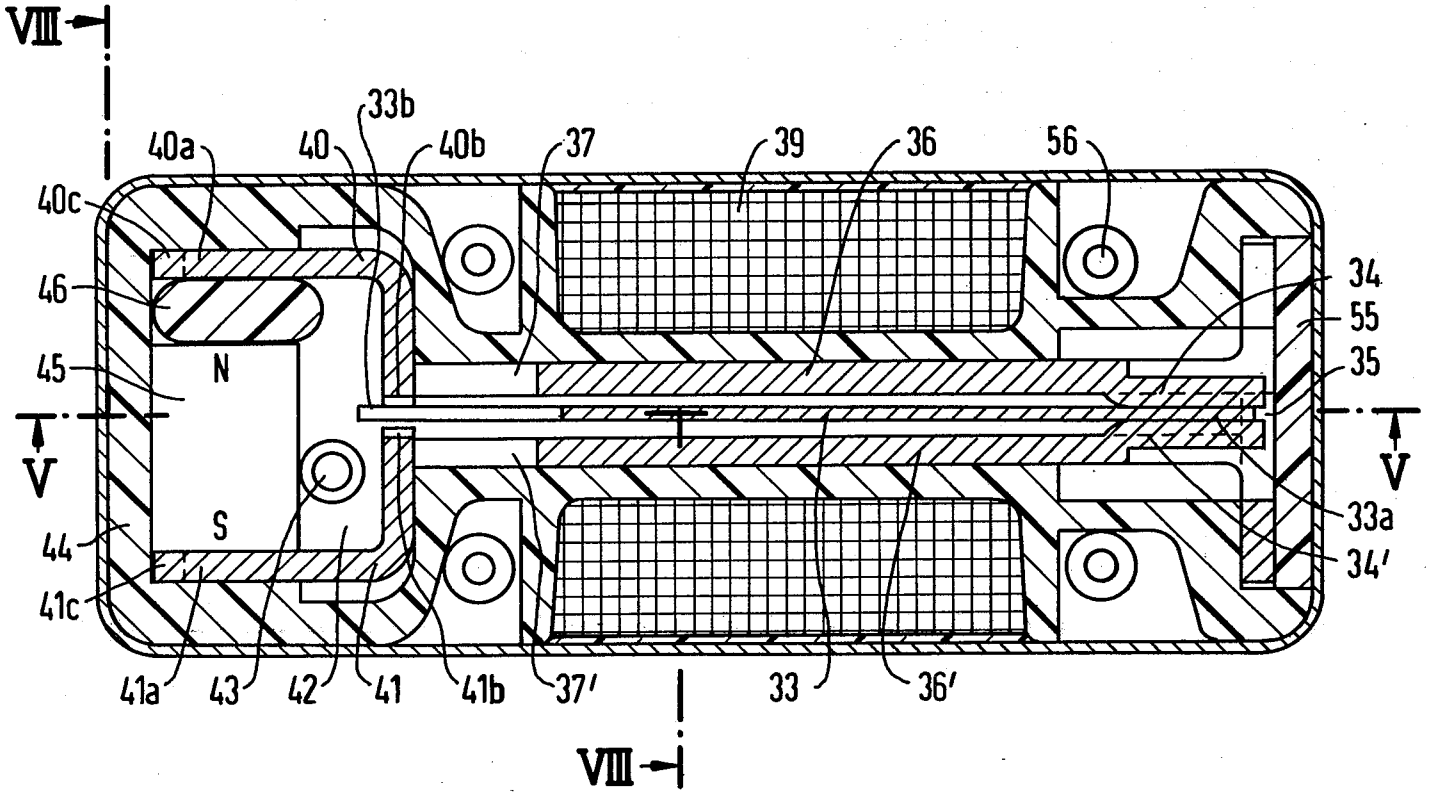
FIG. 6 is a sectional view taken along line VI—VI of FIG. 5.
Figure 8:
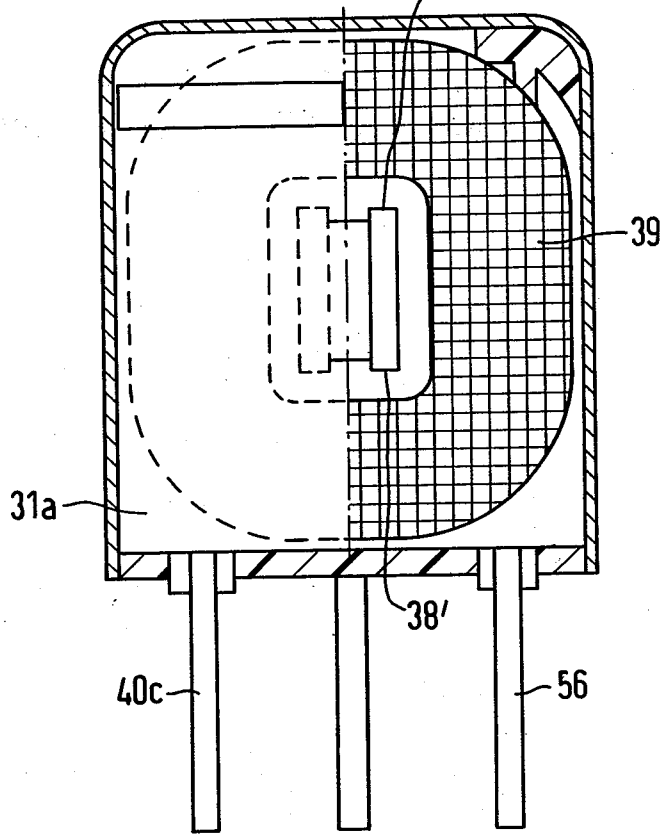
FIG. 8 is a sectional view taken along line VIII—VIII of FIG. 6.
Figure 7:
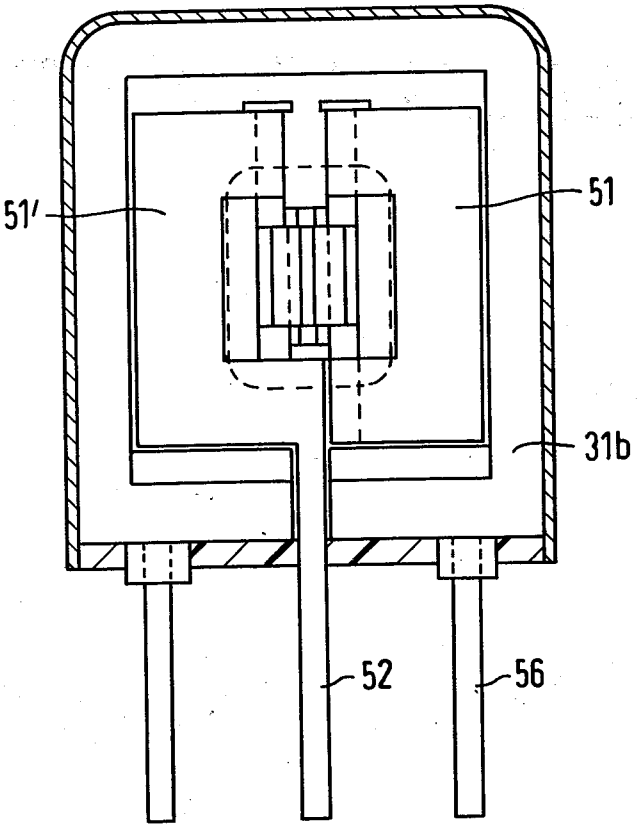
FIG. 7 is a sectional view taken along line VII—VII of FIG. 5.

A polarized electromagnetic relay constructed in accordance with the principles of the present invention is shown in sectional view in FIG. 1 which has a one-piece coil core body 1 which has a tube-like hollow interior contact space 2 with a movable contact element 3 disposed therein substantially parallel to the longitudinal axis of the body 1. The movable contact element 3 is fastened at a fixed end 3*a* to a right angle tab 4 of a carrier 5 by a fastener means 4*a*, shown in FIG. 2. The carrier 5 consists of ferromagnetic material and has an elongated flux guidance plate 6 as a portion thereof which is inserted parallel to the movable contact element 3 in aligned grooves 7 and 8 of the coil body 1. The flux guidance plate 6 is of such a length so as to extend substantially through the entire length of a coil winding 9 wound about the central portion of the coil body 1 and terminates at a free end in close proximity to magnetic pole plates 10 and 11.

The pole plates 10 and 11 are seated in a chamber 12 of a coil flange 1*a*, which is part of the coil body 1, and are mounted in the chamber 12 in respective grooves 13 and 14. The pole plates 10 and 11 are bent at right angles so as to exhibit a square Z cross section and have respective sections 10*a* and 11*a* which enclose a permanent magnet 15, also disposed in the chamber 12. The permanent magnet 15 is disposed asymmetrically with respect to the pole plates 10 and 11 in the embodiment shown in FIGS. 1 through 4 in order to achieve a monostable switching characteristic for the relay. The sections 10*b* and 11*b* of the pole plates 10 and 11 enclose a free end 3*b* of the movable contact element 3. The free end 3*b* of the movable contact element 3 and the surfaces of the sections 10*b* and 11*b* adjacent thereto are coated with electric contact material and in combination form working air gaps with the movable contact element 3 making and breaking with the sections 10*b* and 11*b*. The free end 3*b* of the movable contact element 3 is forked for double contacting.

The pole plates 10 and 11 have terminal pins 10*c* and 11*c* which may be formed integrally with the pole plates 10 and 11 or which may be separately welded thereto. The terminal pins 10*c* and 11*c* are conducted in respective passages 16 and 17 in the coil body 1 from the chamber 12 to the terminal side of the relay. The terminal chamber 12 has an end wall 18 at its end face and, except for the passages 16 and 17, is open only at a top thereof, through which the permanent magnet 15 and the pole plates 10 and 11 are inserted. The opening can then be closed in a simple manner with a planar cover 19 which is put in place on an orbital rim 20 of the chamber 12 and is connected to the coil body 1 in a suitable manner such as by means of bonding, welding or the like.

The coil body has a second flange 1*b* at an opposite end thereof and the carrier 5 for the movable contact element 3 is bent down at right angles through the coil flange 1*b* and is at that location provided with a large-surface flux transfer plate 21 onto which a terminal pin 22 is formed. A good coupling of the carrier 5 to a ferromagnetic housing cover 23 is achieved with the flux transfer plate 21, the housing cover 23 being placed over the coil body 1 and, in addition to closing the magnetic circuit, also effecting a magnetic shielding of the relay. The relay may be hermetically sealed by casting the cover 23 with casting compound 24. The opening of the coil flange 1*b* is covered with a non-woven fabric or plastic foil 25 in order to prevent the casting compound 24 from entering into the contact space 2.

The magnetically conductive movable contact element 3 is secured to the tab 4 of the carrier 5 by the fastening means 4*a* which may be a weld, rivet, screw, or other suitable attachment means. Before insertion of the carrier 5 into the coil body 1, adjustment of the movable contact element 3 is undertaken in a separate adjustment device, wherein the movable contact element 3 is brought to a precisely defined position in relation to the flux guidance plate 6 by means of bending the tab 4. The pre-assembled and pre-adjusted unit consisting of the carrier 5 and the movable contact element 3 is then inserted into the grooves 7 and 8 of the coil body 1 in the contact space 2, whereby the position of the movable contact element is not changed with respect to the carrier 5. The coil body 1 exhibits a seating shoulder 26 for the section 11*b* of the pole plate 11 and seating positions 27 of the grooves 7 and 8 for the section 10*b* of the pole plate 10 in order to fix a specific position for the pole plates within the coil body 1. The seating positions 27 are formed by the undersides of the grooves 7 and 8 both for the flux guidance plate 6 as well as for the section 10*b* of the pole plate 10. The flux guidance plate 6 is pressed against the seating locations 27 and is held in place by a detent 6*b* which aligns the flux guidance plate, and the movable contact element 3, with the section 11*b*. In addition to this mechanically defined positioning of those relay parts which function in spatial combination, an adjustment of the permanent magnet can also be undertaken which is thus a final adjustment of the overall relay characteristics.

Various sectional views are shown in FIGS. 5 through 8 of a further embodiment of the invention which show a polarized electromagnetic relay having a one-piece coil core body 31 with a tube-like interior contact space 32 and a movable contact element 33 disposed therein substantially parallel to the longitudinal axis of the contact space 32. In comparison to the relay shown in FIGS. 1 through 4, the movable contact element 33 is rotated by 90° about the longitudinal axis of the coil, so that its principal plane and the associated contact surfaces are perpendicular to the terminal plane of the relay. The movable contact element 33 is secured at a fixed end 33*a* between two adjustment tabs 34 and 34' of a carrier 35 which has two flux guidance plates 36 and 36' which proceed so as to terminate in proximity to the pole plates 40 and 41 parallel to the movable contact element 33. The pole plates 40 and 41 enclose the free end 33*a* of the movable contact element 33 therebetween. The relay shown in FIGS. 5 through 8 is otherwise constructed substantially identically to the relay described above shown in FIGS. 1 through 4. The flux guidance plate 36 is guided in grooves 37 and 38 and the flux guidance plate 36' is guided in grooves 37' and 38' in the coil body 31. A coil winding 39 is wound about the coil body 31. The free end 33*b* of the contact element 33 interacts with the contact surfaces 40*b* and 41*b* of the pole pieces 40 and 41. In the exemplary embodiment shown in FIGS. 5 through 8, the pole plates 40 and 41 are bent downwardly, however, if necessary the pole plates 40 and 41 can be bent at right angles as are the pole plates 10 and 11 shown in FIG. 1.

A permanent magnet 45 is disposed in a chamber 42 in a coil flange 31*a* between the sections 40*a* and 41*a* of the pole plates 40 and 41. The permanent magnet 45 is fixed in the axial direction of the coil by means of a terminating wall 44 and a peg 43. In the direction of polarization of the magnet 45 between the pole pieces 40 and 41, the magnet 45 is pressed by a filler 46 against the section 41*a* of the pole plate 41 and is separated from the section 40*a* of the other pole plate 40. The two pole plates 40 and 41 are thus also held and secured in place. The chamber 42 is also open at the top and is closed with a cover 49 in a manner identical to that described in connection with the chamber 12 shown in FIG. 1.

The coil body 31 has a second coil flange 31*b* at an opposite end thereof and the carrier 35 exhibits flux transfer plates 51 and 51', which are respective extensions of the two flux guidance plates 36 and 36' in the region of the coil flange 31*b*. The carrier 35 has a terminal pin 52 formed thereon. The entire relay is surrounded by a ferromagnetic housing 53 and, if necessary, may be sealed with casting compound 54. If the relay is sealed with casting compound 54, a plastic or wool foil 55 is inserted prior to casting for preventing penetration of the casting compound 54 into the contact space 32. The terminal pin 52 of the movable contact element 33, the terminal pins 40*c* and 41*c* for the pole plates 40 and 41, as well as the coil terminal pin 56 emerge at the terminal side of the relay in a prescribed grid. Spacing pegs 57 are formed on the lower side of the coil body 1 in order to facilitate placement of the relay.

Assembly of the relay shown in FIGS. 5 through 8 is undertaken in a manner substantially identical to that for the relay described in connection with FIGS. 1 through 4 in such a manner that the movable contact element 33 is pre-adjusted with respect to the flux guidance plates 36 and 36' in a separate device and the pre-adjusted unit consisting of the carrier 35 (including the two flux guidance plates 36 and 36') and the movable contact element 33 are inserted in the grooves in the coil body 1.

Although modifications and changes may be suggested by those skilled in the art it is the intention of the inventor to embody within the patent warranted hereon all changes and modifications as reasonably and properly come within the scope of his contribution to the art.

I claim as my invention:

1. A polarized electromagnetic relay comprising:

a one-piece coil core body with an electromagnetic coil wound thereabout and having a hollow interior along a longitudinal axis thereof;

a movable ferromagnetic contact element disposed in said interior of said coil core body substantially parallel to said longitudinal axis, said movable contact element having a fixed end and a movable free end with contact surfaces thereon;

a permanent magnet and a pair of pole plates associated therewith, said pole plates having contact surfaces disposed on opposite sides of said free end of said movable contact element for making and breaking with said contact surfaces carried thereon;

a carrier seated in at least two aligned longitudinal grooves in said interior of said coil core body, said carrier having said fixed end of said movable contact element fastened thereto and said carrier having at least one flux guidance plate in registry with and extending substantially up to said pole plates;

a chamber integrally formed in said coil core body in which said pole plates are mounted, said chamber having an open top and being otherwise closed and having guidance grooves for receiving said pole plates, said pole plates each having a terminal pin and said chamber having a pair of passages at a bottom thereof for receiving said terminal pins, said chamber further having an orbital rim at said top thereof; and a planar cover seated on said orbital rim for closing said chamber.

2. The relay of claim 1 wherein said carrier has two flux guidance plates respectively extending substantially parallel along opposite sides of said movable contact element substantially up to respective ones of said pole plates.

3. The relay of claim 2 wherein said coil core body further comprises a seating surface and wherein at least one flux guidance plate has a detent formed thereon, said flux guidance plate being pressed against said seating surface and said detent aligning said flux guidance plate with a pole plate.

4. The relay of claim 1 wherein said flux guidance plate and said contact surfaces on said movable contact element and on said pole plates are disposed parallel to a terminal plane of said relay.

5. The relay of claim 1 wherein said flux guidance plate and said contact surfaces of said movable contact element and said pole plates are disposed perpendicular to a terminal plane of said relay.

6. The relay of claim 2 wherein said permanent magnet is also disposed in said chamber between said pole plates.

7. The relay of claim 6 wherein said permanent magnet is asymmetrically disposed between said pole plates such that said magnet is seated with one pole surface thereof against a portion of one pole plate and the other pole surface of said magnet is separated from the other pole plate by a non-magnetic filler.

8. The relay of claim 6 further comprising a retaining element integrally formed in said chamber abutting said permanent magnet for laterally fixing the position of said permanent magnet in said chamber.

9. The relay of claim 1 further comprising a ferromagnetic housing cover and wherein said carrier further has a flux transfer plate disposed against an end face of said coil core body and parallel to an end wall of said housing cover.

10. The relay of claim 1 further comprising a foil covering and closing an end of said hollow interior of said relay and wherein said relay is sealed by casting compound, said foil preventing said casting compound from entering said hollow interior.

* * * * *